US008316480B2

(12) United States Patent
Burak, Jr. et al.

(10) Patent No.: US 8,316,480 B2
(45) Date of Patent: Nov. 27, 2012

(54) MOBILE CANTILEVER TRANSFER DEVICE

(75) Inventors: William E. Burak, Jr., Austin, TX (US); Frederic Palay, Sugarloaf Key, FL (US)

(73) Assignee: Technimotion, LLC, San Antonio, TX (US)

( * ) Notice: Subject to any disclaimer, the term of this patent is extended or adjusted under 35 U.S.C. 154(b) by 62 days.

(21) Appl. No.: 12/333,078

(22) Filed: Dec. 11, 2008

(65) Prior Publication Data

US 2009/0158523 A1 Jun. 25, 2009

Related U.S. Application Data

(60) Provisional application No. 61/013,157, filed on Dec. 12, 2007.

(51) Int. Cl.
*A61G 7/10* (2006.01)

(52) U.S. Cl. ..... 5/87.1; 5/81.1 HS

(58) Field of Classification Search ..... 5/87.1, 5/81.1 HS

See application file for complete search history.

(56) References Cited

U.S. PATENT DOCUMENTS

| | | | | |
|---|---|---|---|---|
| 662,477 | A | 11/1900 | Ulrich | |
| 935,170 | A | 9/1909 | Smith | |
| 1,876,832 | A | 9/1932 | Bancroft | |
| 1,961,119 | A | 5/1934 | Ettinger | |
| 2,362,721 | A | 11/1944 | Reynolds | |
| 2,587,068 | A * | 2/1952 | Sanders | 5/86.1 |
| 2,666,930 | A | 1/1954 | Lenahan | |
| 2,673,987 | A | 4/1954 | Upshaw et al. | |
| 2,739,783 | A | 3/1956 | Pentecost | |
| 3,099,020 | A | 7/1963 | Garfield et al. | |
| 3,131,404 | A | 5/1964 | Bowers et al. | |
| 3,271,796 | A | 9/1966 | Dillman | |
| 3,310,816 | A | 3/1967 | James et al. | |
| 3,732,584 | A | 5/1973 | James | |
| 3,811,140 | A | 5/1974 | Spann | |
| 3,829,916 | A | 8/1974 | James | |
| 3,940,808 | A | 3/1976 | Petrini | |
| 3,981,484 | A | 9/1976 | James | |
| 3,988,790 | A * | 11/1976 | Mracek et al. | 5/83.1 |
| 4,010,499 | A | 3/1977 | Davis et al. | |
| 4,138,750 | A | 2/1979 | Michalowski | |
| 4,232,412 | A | 11/1980 | Petrini | |
| 4,274,168 | A * | 6/1981 | Depowski | 5/81.1 HS |
| 4,393,529 | A | 7/1983 | Britz | |

(Continued)

FOREIGN PATENT DOCUMENTS

| | | | |
|---|---|---|---|
| EP | 452072 | A2 | 10/1991 |

(Continued)

*Primary Examiner* — Robert G Santos
*Assistant Examiner* — Brittany Wilson
(74) *Attorney, Agent, or Firm* — Fulbright & Jaworski L.L.P.

(57) ABSTRACT

A preferred embodiment of the present invention comprises a mobile cantilever transfer device for transferring mobility-impaired patients. In one embodiment, the mobile cantilever transfer device includes a support surface that is cantilevered from a lift cart so that the support surface may be positioned over the origination or destination location for a transfer, such as a patient's bed. In yet another embodiment, the cantilevered support surface may be laterally extended from the lift cart in order to allow the support surface to be positioned at different points over a transfer location without moving the lift cart. In yet another embodiment, multiple sides of the support surface may be connected to the lift cart so that a transfer can be accomplished from multiple directions, such as on either side of a patient's bed.

29 Claims, 6 Drawing Sheets

U.S. PATENT DOCUMENTS

| | | | | |
|---|---|---|---|---|
| 4,432,359 | A | 2/1984 | James | |
| 4,554,691 | A | 11/1985 | Daugherty | |
| 4,579,381 | A | 4/1986 | Williams | |
| 4,631,761 | A | 12/1986 | Lederman | |
| 4,633,538 | A | 1/1987 | James | |
| 4,669,943 | A | 6/1987 | Zamotin | |
| 4,737,997 | A | 4/1988 | Lamson | |
| 4,783,862 | A | 11/1988 | Murphy | |
| 4,794,655 | A | 1/1989 | Ooka et al. | |
| 4,858,261 | A | 8/1989 | Iura | |
| 4,862,997 | A | 9/1989 | Eberle | |
| 4,920,590 | A | 5/1990 | Weiner | |
| 4,970,738 | A | 11/1990 | Cole | |
| 4,987,620 | A | 1/1991 | Sharon | |
| 4,997,200 | A | 3/1991 | Earls | |
| 5,022,810 | A | 6/1991 | Sherrow et al. | |
| 5,023,968 | A | 6/1991 | Diehl et al. | |
| 5,038,425 | A | 8/1991 | Merry | |
| 5,112,076 | A | 5/1992 | Wilson | |
| 5,163,189 | A | 11/1992 | DeGray | |
| 5,193,633 | A | 3/1993 | Ezenwa | |
| 5,255,934 | A | 10/1993 | Wilson | |
| 5,257,425 | A | 11/1993 | Shinabarger | |
| 5,263,213 | A | 11/1993 | Robertson et al. | |
| 5,333,887 | A | 8/1994 | Luther | |
| 5,355,538 | A | 10/1994 | Fulford et al. | |
| 5,375,277 | A | 12/1994 | Carr et al. | |
| 5,379,468 | A | 1/1995 | Cassidy et al. | |
| 5,388,289 | A | 2/1995 | Casperson | |
| 5,572,756 | A | 11/1996 | Muuranen et al. | |
| 5,626,398 | A | 5/1997 | Wooldridge | |
| 5,651,149 | A * | 7/1997 | Garman | 5/81.1 R |
| 5,704,081 | A | 1/1998 | Bollinger | |
| 5,708,993 | A | 1/1998 | Campbell et al. | |
| 5,754,992 | A | 5/1998 | Melnick et al. | |
| 5,896,602 | A | 4/1999 | Marblestone | |
| 5,934,282 | A | 8/1999 | Young, III et al. | |
| 5,937,456 | A | 8/1999 | Norris | |
| 5,966,754 | A | 10/1999 | Schuster | |
| 5,996,150 | A | 12/1999 | Blevins et al. | |
| 6,131,215 | A | 10/2000 | Lindell | |
| 6,154,899 | A | 12/2000 | Brooke et al. | |
| 6,336,235 | B1 | 1/2002 | Ruehl | |
| 6,381,781 | B1 | 5/2002 | Bourgraf et al. | |
| 6,427,270 | B1 | 8/2002 | Blevins et al. | |
| 6,430,761 | B1 | 8/2002 | Brandorff et al. | |
| 6,477,728 | B1 | 11/2002 | Faz | |
| 6,651,280 | B2 | 11/2003 | Blevins | |
| 6,691,349 | B2 | 2/2004 | Blevins | |
| 6,799,770 | B2 | 10/2004 | Patrick et al. | |
| 6,834,402 | B2 | 12/2004 | Hanson et al. | |
| 6,854,137 | B2 * | 2/2005 | Johnson | 5/88.1 |
| 7,000,268 | B2 | 2/2006 | Johnson | |
| 7,487,559 | B1 * | 2/2009 | Denosky | 5/81.1 HS |
| 7,752,687 | B1 * | 7/2010 | Denosky | 5/81.1 HS |
| 2003/0213064 | A1 | 11/2003 | Johnson | |
| 2004/0049855 | A1 | 3/2004 | Leoutsakos | |
| 2004/0154097 | A1 | 8/2004 | Blevins | |
| 2005/0135907 | A1 | 6/2005 | Romano et al. | |
| 2006/0213007 | A1 | 9/2006 | Palay et al. | |
| 2007/0028381 | A1 | 2/2007 | Palay et al. | |

FOREIGN PATENT DOCUMENTS

| | | | |
|---|---|---|---|
| EP | 518692 | A1 | 12/1992 |
| EP | 1 142 550 | | 10/2001 |
| GB | 2 213 735 | | 8/1989 |
| GB | 2242885 | A | 10/1991 |
| GB | 2 277 020 | | 10/1994 |
| WO | WO-91/12972 | A1 | 9/1991 |
| WO | WO-98/34575 | A2 | 8/1998 |
| WO | WO-2004/039300 | A1 | 5/2004 |
| WO | PCT/US2006/009066 | | 9/2007 |
| WO | PCT/US2008/086672 | | 2/2009 |

* cited by examiner

MOBILE CANTILEVER TRANSFER DEVICE

CROSS-REFERENCE TO RELATED APPLICATIONS

This non-provisional application claims priority based upon prior U.S. Provisional Patent Application Ser. No. 61/013157 filed Dec. 12, 2007 in the name of William E. Burak, Jr. and Frederic Palay, entitled "Bed Side Cantilever Transfer Chair," the disclosure of which is incorporated herein by reference.

BACKGROUND OF THE INVENTION

The present invention relates generally to patient handling systems and, more particularly, to patient handling systems with a mobile cantilever transfer device.

The field of patient handling is gaining increased attention as a result of nursing shortages, caregiver injuries, and the rising incidence of obesity in western societies. At the same time, existing approaches to patient handling have several limitations. Manual patient handling systems, for example, generally rely on various lifting and sliding techniques to move a patient. Such systems can lead to discomfort and injury to both patient and caregiver and, in many cases, require the presence of more than one caregiver.

Traditional mechanical solutions, such as floor-based hoists, ceiling lifts, and lateral transfer systems, have been shown to decrease the incidence of caregiver musculoskeletal injury but still present significant safety risks to patients. For instance, traditional mechanical solutions typically involve placing a patient on a temporary support surface, such as a sling or sheet, lifting the support surface that contains the patient into the air, moving the support surface and patient over the floor to the desired transfer location, and carefully lowering the support surface and patient onto the desired transfer destination. Such lifting, moving, and lowering sequences have resulted in numerous reported instances of patient injury, including instances involving the serious injury or death of patients as a result of patients falling from several feet above the floor.

Other mechanical transfer systems in the prior art have attempted to eliminate such patient lifting, moving, and lowering by laterally transferring patients. A lateral patient transfer may involve raising a support surface to the same level as the patient's bed so the patient can roll or slide from the patient's bed onto the support surface. Some attempts have also been made to cantilever a support surface from a lift cart so that the support surface can be raised and placed on top of a patient's bed. An overlap between the support surface and the patient's bed reduces the distance that a patient must be moved to reach the support surface and reduces the risk of the patient falling during the transfer. The effectiveness of existing systems that cantilever a support surface from a lift cart has been severely limited, however, by their inability to allow the support surface to reach different points on a patient's bed, including the middle of a patient's bed, regardless of the width of the patient's bed and without moving the lift cart. In addition, at least some existing systems that cantilever a support surface from a lift cart have proven to be not well suited for environments that restrict the direction from which a patient may be transferred, such as environments that restrict a transfer to a specific side of a bed.

The effectiveness of existing systems that cantilever a support surface from a lift cart has also been severely limited by their inability to transfer patients in a supine, semi-reclined or upright position. For example, some patients have trouble lying in a supine position and lying in a supine position increases the risk of patient aspiration. At the same time, other patients have trouble sitting upright.

Therefore, it can be appreciated that there is a significant need for a mobile cantilever transfer device that will reach different points on a patient's bed, including the middle of a patient's bed, regardless of the width of the patient's bed and without moving the lift cart of the mobile cantilever transfer device. It can further be appreciated that there is a significant need for a mobile cantilever transfer device that can transfer a patient from more than one direction. It can further be appreciated that there is a significant need for a mobile cantilever transfer device that can transfer a patient in a supine, semi-reclined or upright position. The present invention provides these and other advantages, as will be apparent from the following detailed description and accompanying figures.

BRIEF SUMMARY OF THE INVENTION

A preferred embodiment of the present invention comprises a mobile cantilever transfer device for transferring mobility-impaired patients. In one embodiment, the mobile cantilever transfer device includes a support surface that is cantilevered from a lift cart so that the support surface may be positioned directly adjacent to or over the origination or destination location for the transfer, such as a patient's bed. In another embodiment, the mobile cantilever transfer device is height-adjustable to allow a caregiver to raise or lower the support surface relative to the height of the transfer location. In yet another embodiment, the cantilevered support surface may be laterally extended or retracted from the lift cart. This feature allows the support surface to be positioned at different points over a transfer location without requiring the lift cart to be moved. This feature also allows the support surface to reach desired positions over a transfer location regardless of the width of the desired transfer location and regardless of whether the lift cart can be positioned directly adjacent to the transfer location. In yet another embodiment, multiple sides of the support surface may be connected to the lift cart so that a transfer can be accomplished from multiple directions, such as on either side of a patient's bed. In yet another embodiment, the mobile cantilever transfer device can be used in connection with a floor or ceiling lift. In yet another embodiment, the support surface can be fully reclined, semi-reclined or upright. In yet another embodiment, the mobile cantilever transfer device can transfer a patient in a fully reclined, semi-reclined or upright position. In yet another embodiment, bathing and toileting accessories can be mounted to the support surface or lift cart. In yet another embodiment, the legs of the lift cart can be laterally extended. In yet another embodiment, the support surface has retractable arm rests that may be moved or detached so as to not interfere with patient transfers. In yet another embodiment, the support surface can be removed from the lift cart, placed underneath a patient, and then reconnected to the lift cart once the patient is safely positioned onto the support surface. In yet another embodiment, the support surface can rotate or pivot about its vertical axis.

DETAILED DESCRIPTION

A preferred embodiment of the present invention comprises a mobile cantilever transfer device for transferring mobility-impaired patients. In one embodiment, the mobile cantilever transfer device includes a support surface that is cantilevered from a lift cart so that the support surface may be positioned directly adjacent to or over the origination or destination location for the transfer. For example, the support surface may be positioned over a patient's bed to allow the patient to be placed on the support surface prior to being moved away from the bed. In this manner, the mobile cantilever transfer device allows transfers with minimal safety risk to patient and caregiver. The mobile cantilever transfer device can be used in a hospital, long-term care facility, rehabilitation facility, in a patient's home or other locations and can be used alone or in conjunction with other patient lifting devices such as a ceiling lift, a floor-based hoist, low-friction sliding transfer sheets or a sliding roller board.

Figure 1:
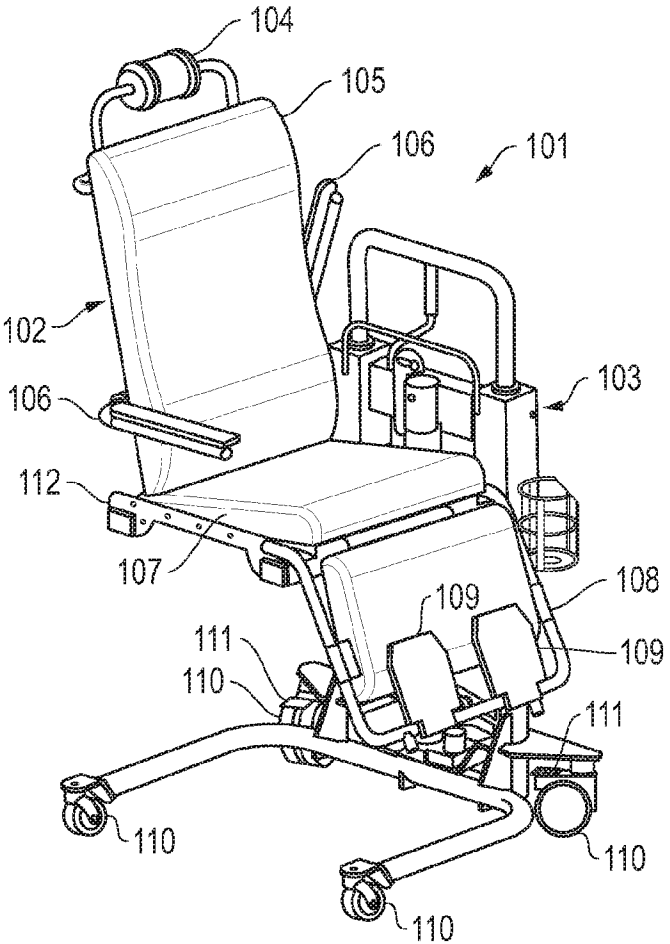
FIG. 1 shows a perspective view of one embodiment of the device of the present invention with the support surface in an upright position.

Reference is now made to FIG. 1 which shows a perspective view of one embodiment of the device of the present invention with the support surface in an upright position. In this embodiment, the mobile cantilever transfer device 101 that includes a support surface 102 and a lift cart 103. The lift cart 103 may contain wheels 110 which allow it to roll across ground surfaces. Two of the four wheels 110 shown also contain brakes 111 which can be locked by a caregiver to prevent the lift cart from rolling. The support surface 102 is shown securely mounted to or locked onto the lift cart 103. The support surface 102 in this embodiment includes a seat frame 112, a back support 105, a headrest 104, arm rests 106, a seat support 107, a leg support 108, and foot rests 109. In this embodiment, the headrest 104, the back support 105, the arm rests 106, the seat support 107 and the leg support 108 are cushioned.

The support surface 102 is shown in an essentially upright position such that the back support 105 is just slightly reclined from a vertical position and is approximately perpendicular to the seat support 107. The seat support 107 is shown dipping slightly downward from the horizontal seat frame 112 in the direction towards the back support 105 and in the direction away from the leg support 108. The leg support 108 is shown extending down from the seat frame 112 in a direction that is approximately perpendicular to the position of the seat support 107. The foot rests 109 are shown in an upright position that is approximately parallel to the slope of the leg support 108.

Figure 2:
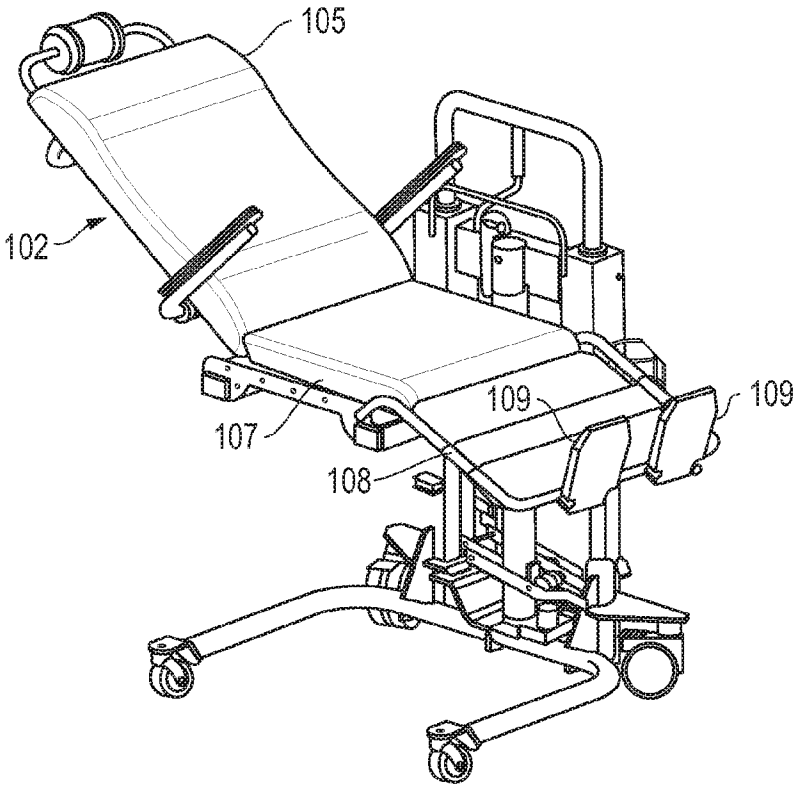
FIG. 2 shows a perspective view of one embodiment of the device of the present invention with the support surface in a semi-reclining position.

Reference is now made to FIG. 2 which shows a perspective view of one embodiment of the device of the present invention with the support surface 102 in a semi-reclining position. The support surface 102 is also capable of reclining into a fully reclined or horizontal position and may be fixed into position at any angle from fully reclined to upright. The support surface 102 is shown in a semi-reclining position such that the slope of the back support 105 is approximately forty degrees above horizontal, the slope of the seat support 107 is approximately horizontal, and the slope of the leg support 108 dips approximately twenty degrees below horizontal. The foot rests 109 are shown in an extended position that is approximately perpendicular to the slope of the leg support 108.

Figure 3:
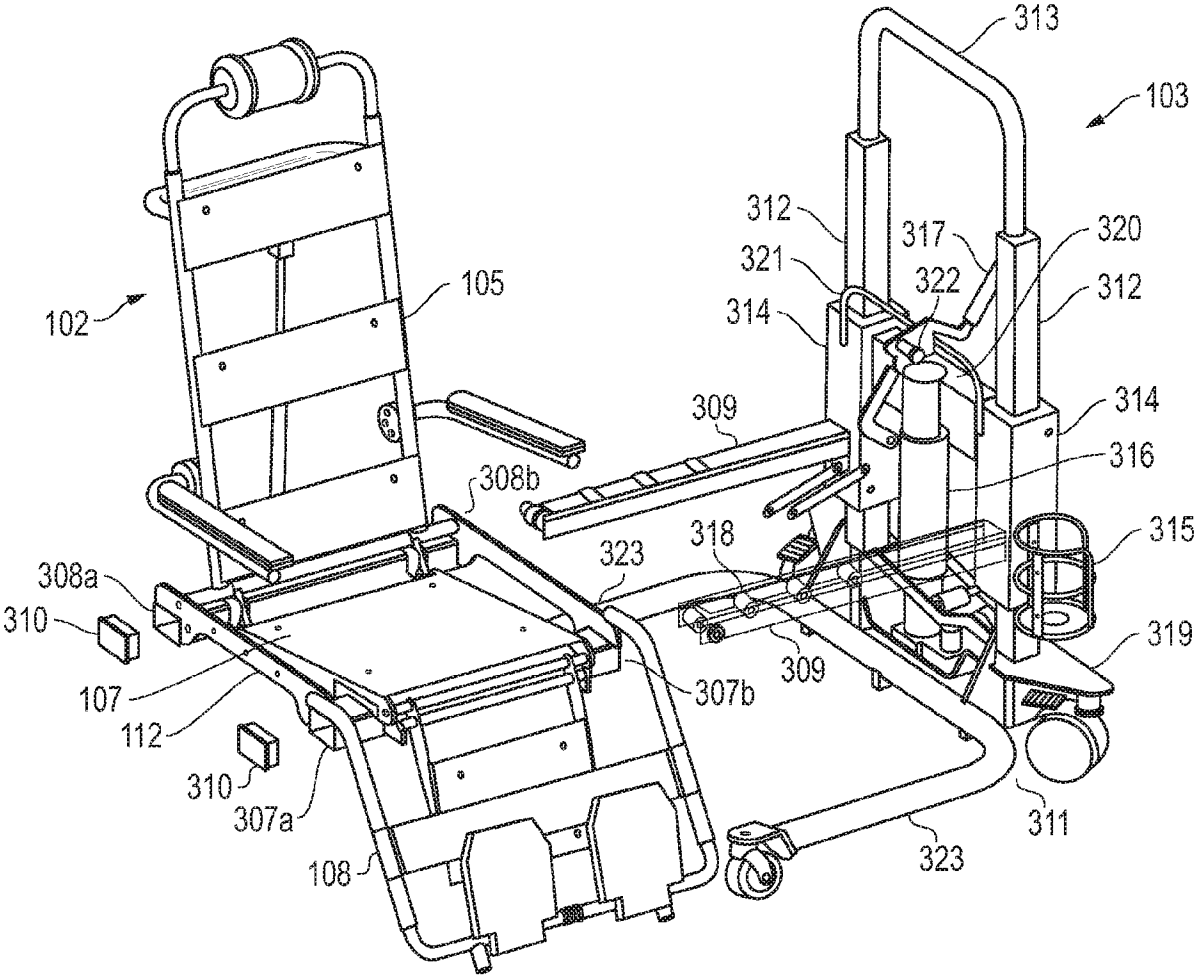
FIG. 3 shows a perspective view of one embodiment of the device of the present invention with the support surface adjacent to the lift cart.

Reference is now made to FIG. 3 which shows a perspective view of one embodiment of the device of the present invention with the support surface 102 adjacent to the lift cart 103. In this embodiment, the frame of the support surface 102 is shown detached from the lift cart 103 and without cushioning on the back support 105, seat support 107 or leg support 108. The seat frame 112 is shown to contain a first female connection conduit 307 that is attached underneath the front end of the seat frame 112, the end nearest to the leg support 108, and a second female connection conduit 308 that is attached at the back end of the seat frame 112, the end that connects to the seat support 107 and the back support 105. The support surface 102 can be securely mounted to the lift cart 103 by sliding and locking the female connection conduits 307 and 308 onto the lift-forks 309 of the lift cart 103. End caps 310 may be used to cover the open ends of the female connection conduits 307 and 308. While two female connection conduits 307 and 308 and two lift-forks 309 are shown in this embodiment, it can be appreciated that other embodiments can include only one female connection conduit and or lift-fork or, alternatively, other types of connection mechanisms without departing from the spirit and scope of the invention.

A caregiver may elect to mount the support surface 102 to the lift cart 103 by first sliding the proximal ends of the female connection conduits **307*b* and 308*b* onto the lift-forks 309 or, alternatively, the support surface 102 may be mounted to the lift cart 103 by first sliding the distal ends of the female connection conduits 307*a* and 308*a* onto the lift-forks 309 of the lift cart 103. With this option, the caregiver can choose the direction that the support surface 102 faces with respect to the lift cart 103. If a patient can only be transferred from one side of a patient bed, for example, the caregiver can attach the support surface 102 to the lift cart 103 in the direction that allows the transfer to be performed with the back support 105 supporting the patient's backside rather than the patient's legs. It can be appreciated that inserting the lift-forks 309 into the female connection conduits 307 and 308 also allows the support surface 102 to be mounted to the lift cart 103**.

A caregiver may also elect to extend or retract the cantilevered support surface 102 along the lift-forks 309 so that the support surface 102 is positioned a desired distance from the lift cart 103. This lateral movement of the support surface 102 may be accomplished by different means, such as by an electronic actuator, hydraulic pump, manually, or mechanically, without departing from the spirit and scope of the invention. In this embodiment, a caregiver may mechanically extend the support surface 102 away from the lift cart 103 by depressing the extension hand lever 317 located on the lift cart 103 and a caregiver may mechanically retract the support surface 102 towards the lift cart 103 by raising the extension hand lever 317. Rollers 318 partially embedded in the lift-forks 309 may also be used to assist the lateral sliding movement of the support surface 102 on the lift-forks 309. The extension hand lever 317 may also include a locking device 322 to prevent errant movement of the extension hand lever 317 and support surface 102. The lateral movement of the support surface 102 allows the support surface 102 to be positioned at different points over a transfer location without requiring the lift cart 103 to be moved. This feature also allows the support surface 102 to reach desired positions over a transfer location regardless of the width of the desired transfer location and regardless of whether the lift cart 103 can be positioned directly adjacent to the transfer location.

Still referring to FIG. 3, the lift cart 103 is shown to contain an upright central structure that includes two vertical support bars 312 that connect to a caregiver handle 313 and a support base 319. A cylindrical hydraulic pump 316 may also extend vertically from the support base 319 and in between the two vertical support bars 312. The top of the cylindrical hydraulic pump 316 may contain a horizontal extension 320 that connects to two sliding sleeves 314, each of which are moveably connected to a portion of the vertical support bars 312. The cylindrical hydraulic pump 316 may be used to move the sliding sleeves 314 up and down the vertical support bars 312. The movement of the sliding sleeves 314 may also move the lift-forks 309 that are connected to the sliding sleeves 314, as well as the support surface 102 if the support surface 102 is connected to the lift-forks 309. In addition, a u-shaped frame 311 is also shown attached to the support base 319 to provide stability to the upright central structure. In one embodiment, the length of the legs 323 of the u-shaped frame 311 may be laterally extended in order to provide additional stability to the lift cart 103 when the support surface 102 is extended. For example, the legs 323 may include telescoping extensions. Also, a grip bar 321 is shown attached to the sliding sleeves 314. The grip bar 321 serves as a handle for carrying the lift cart 102 and also prevents a patient from errantly touching the extension hand lever 317. Various accessories, such as an oxygen bottle holder 315, may also be attached to the lift cart 103.

Figure 4:
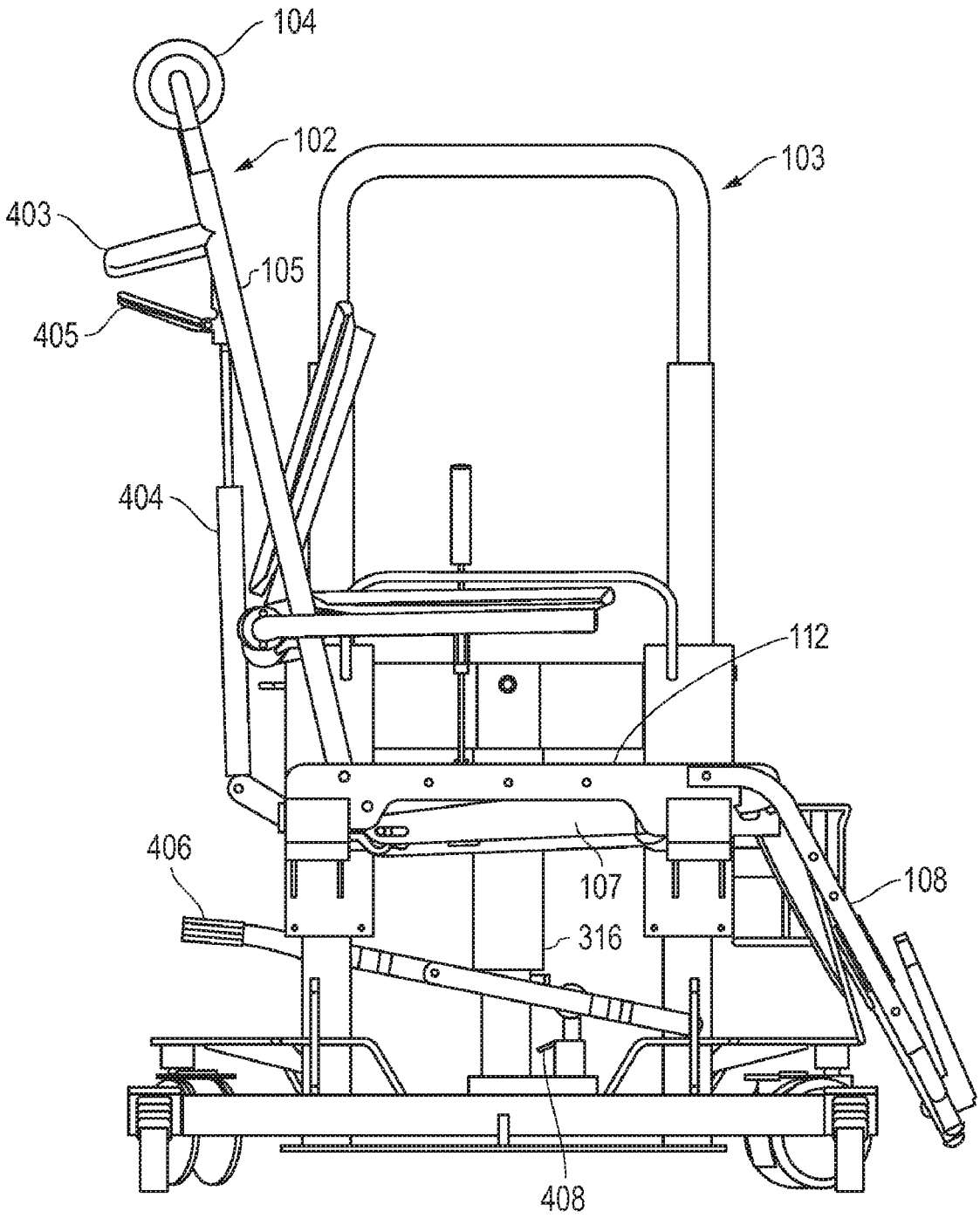
FIG. 4 shows a side view of one embodiment of the device of the present invention with the support surface in an upright position.

Reference is now made to FIG. 4 which shows a perspective view of one embodiment of the device of the present invention with the support surface 102 in an upright position. In this embodiment, the support surface 102 is shown attached to the lift cart 103. A locking gas spring 404 is also shown connected to both the upper backside of the back support 105 of the support surface 102 and to the end of the seat frame 112 that connects to the back support 105. A reclining lever 405 may be attached to the locking gas spring 404 to restrict or release movement of the locking gas spring 404 in order to control the reclining position of the back support 105. When the locking gas spring 404 is allowed to contract, for instance, the end of the back support 105 that is connected to the head rest 104 may move downward and the end of the back support 105 that is connected to the seat support 107 may move horizontally towards the leg support 108. In other embodiments, the reclining position can be controlled by alternative means such as by use of an actuator, hydraulic cylinder or zero-gravity system. In addition, a support surface handle 403 is shown attached to the upper backside of the back support 105 of the support surface 102. The support surface handle 403 can be used, for example, to push or pull the mobile cantilever transfer device when the support surface 402 is attached to the lift cart 103.

Still referring to FIG. 4, a foot pedal 406 is shown for raising or releasing the cylindrical hydraulic pump 316. In other embodiments, the lift-forks 309 of the lift cart 103 may be raised or lowered using alternative powered lifting mechanisms such as an actuator, motor or mechanical jack. A locking device 408 is also shown that allows a caregiver to fix the height of the support surface 102 or lift-forks 309 once a desired height is reached.

Figure 5:
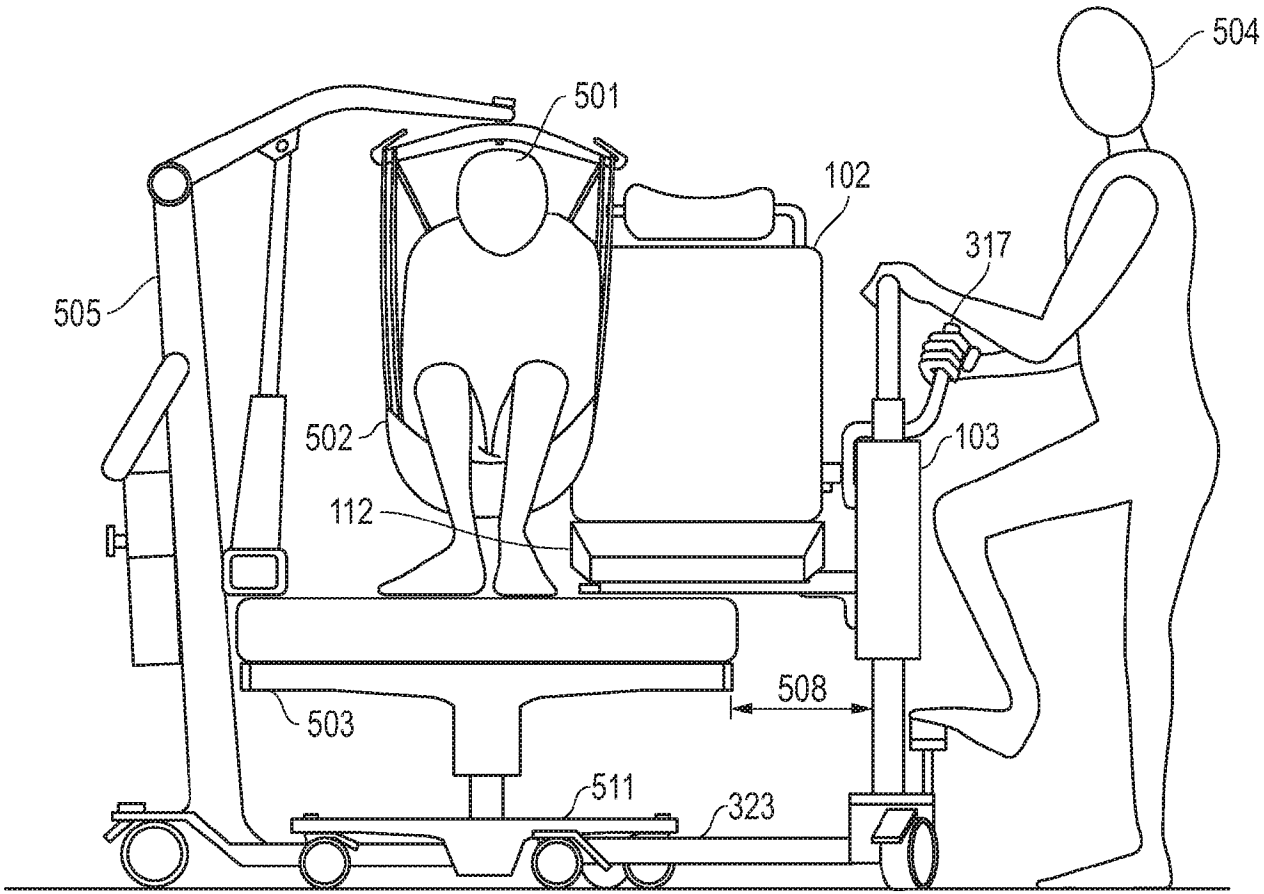
FIG. 5 shows a first example operation of one embodiment of the device of the present invention used in conjunction with a floor lift.

Reference is now made to FIG. 5 which shows a first example operation of one embodiment of the device of the present invention used in conjunction with a floor lift. A patient 501 is shown sitting in a semi-reclined position within the confines of a lifting sling 502 that has been placed beneath the thighs and upper back of the patient 501. The patient 501 has been lifted directly up with the floor lift 505 so that the patient 501 is only a few inches in the air and directly above the patient's bed 503. The caregiver 504 has also raised the height of the support surface 102 so that the bottom of the seat frame 112 of the support surface 102 will fit snuggly on top of the patient's bed 503. The support surface 102 is shown in a semi-reclined position but the caregiver 504 may alternatively elect to position the support surface 102 in an upright or fully-reclined position in order to perform the transfer with the patient 501 in an upright or supine position. The caregiver 504 has also elected to fix the lift cart 103 in place some distance 508 away from the patient's bed 503. In some environments, the caregiver 504 may not be able to place the lift cart 103 directly adjacent to the transfer location due to, for example, obstructions 511 blocking the legs 323 of the lift cart 103. The caregiver 504 is shown depressing the extension hand lever 317 in order to extend the support surface 102 directly underneath the patient 501.

Figure 6:
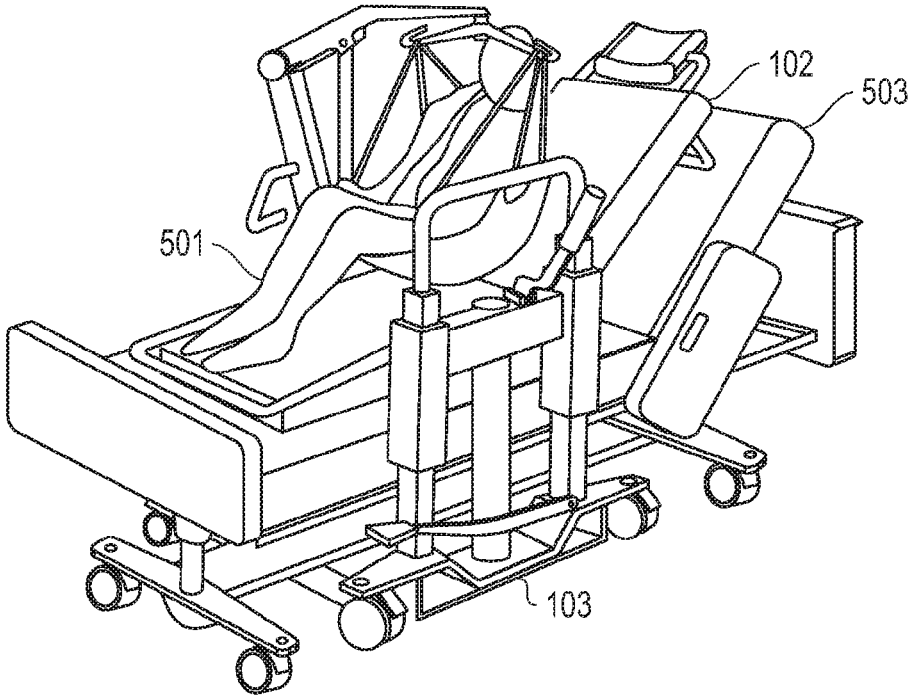
FIG. 6 shows one embodiment of the device of the present invention with a support surface placed underneath a patient.

Reference is now made to FIG. 6 which shows one embodiment of the device of the present invention with a support surface 102 placed underneath a patient 501. The suspended patient 501 can then either be lowered onto the support surface 102 or the support surface 102 can be raised to support the suspended patient 501. In an alternative operation, the support surface 102 may be placed underneath the suspended patient 501 and the patient 501 can be lowered onto the support surface 102 before the support surface 102 is connected to the lift cart 103. In any event, the entire transfer may be performed safely over the confines of the patient's bed 503.

Figure 7:
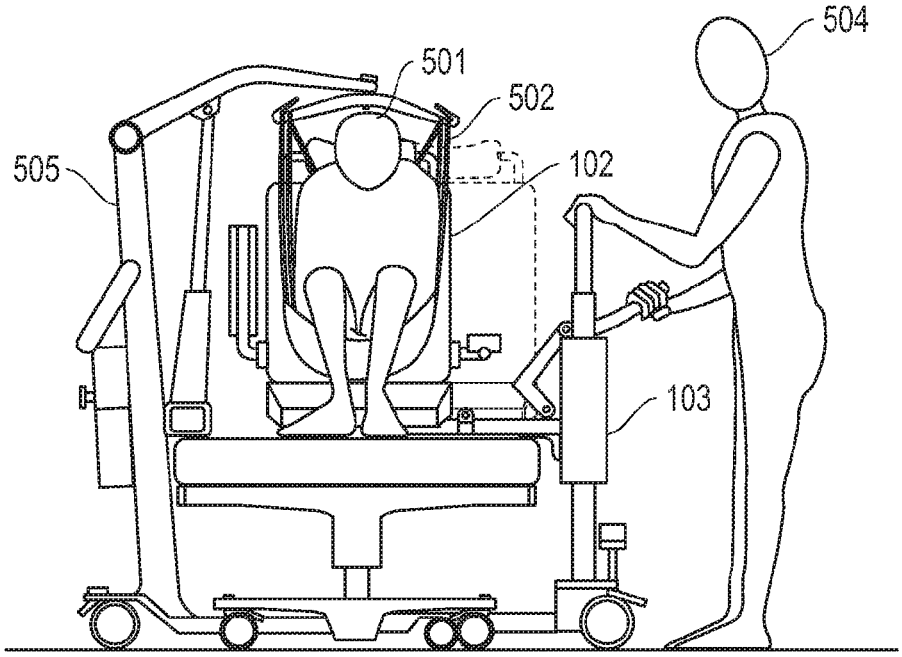
FIG. 7 shows a second example operation of one embodiment of the device of the present invention used in conjunction with a floor lift.

Reference is now made to FIG. 7 which shows a second example operation of one embodiment of the device of the present invention used in conjunction with a floor lift 505. Once the patient 501 is securely supported by the support surface 102, the caregiver 504 can easily remove the lifting sling 502 from underneath the patient 501 and retract the support surface 102 towards the lift cart 103. The caregiver 504 can then transport the patient 501 in the mobile cantilever transfer device 101. The support surface 102 can also be placed in multiple reclined positions depending on the needs and comfort of the patient 501.

Figure 8:
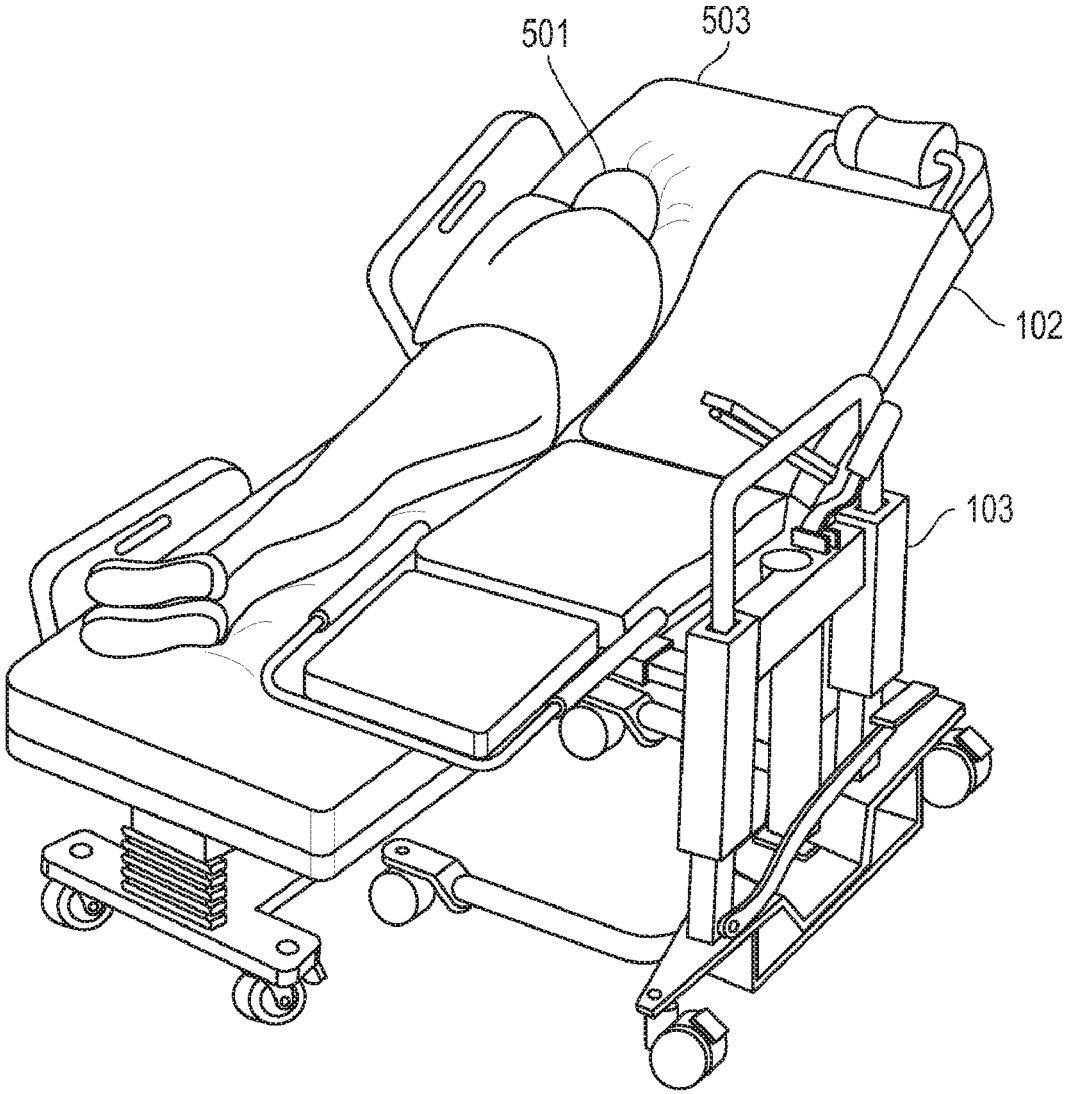
FIG. 8 shows an example operation of one embodiment of the device of the present invention used without an additional lifting device.

Reference is now made to FIG. 8 which shows an example operation of one embodiment of the device of the present invention used without an additional lifting device. The patient 501 is shown having rolled onto her right side and the support surface 102 has been extended from the lift cart 103 to a degree so that the support surface 102 rests over a portion of the patient's bed 503. From this position, the patient 501 may roll onto her back and onto the support surface 102.

The mobile cantilever transfer device 101 may be stored at the bedside of a patient 501 for the immediate accessibility of a caregiver 504. Additionally, a removable tabletop can also be attached to the lift-forks 309 of the lift cart 103 so that the lift cart 103 may be used as a height-adjustable table. In other embodiments, the support surface 102 may include various bathing and toileting accessories. Bathing and toileting accessories may be mounted to a portion of the support surface 102, such as the seat frame 112, or mounted directly to the lift-forks 309. In yet another embodiment, the support surface 102 may rotate, or yaw, about its vertical body axis while the support surface 102 is connected to the lift cart 103.

It will be appreciated by persons skilled in the art that the present invention is not limited by what has been particularly shown and described hereinabove and other embodiments may fall within the spirit and scope of the invention, as defined by the following claims.

What is claimed is:

1. A mobile cantilever transfer device comprising:

a lift cart, said lift cart including at least one lift-fork;

a support surface, wherein said support surface is configured to support a patient and includes a seat frame with at least one female connection conduit attached to the underside of said seat frame;

said lift cart being able to raise and lower said support surface;

said lift cart being able to laterally extend said support surface away from said lift cart while said lift cart is temporarily fixed in place; and said lift cart being able to laterally retract said support surface towards said lift cart while said lift cart is temporarily fixed in place;

wherein said support surface is configured to be securely cantilevered from said lift cart by inserting said at least one lift-fork into said at least one female connection conduit.

2. The device of claim 1, wherein said support surface may be laterally extended and retracted in an upright, semi-reclined, or fully reclined position.

3. The device of claim 1, wherein said support surface includes a seat frame, back support, seat support, and leg support.

4. The device of claim 1, wherein said at least one female connection conduit extends laterally across the underside of said seat frame and said at least one lift-fork may be inserted into either a distal or a proximal end of said at least one female connection conduit.

5. The device of claim 1, wherein said at least one lift-fork is mounted to a sliding sleeve that is raised and lowered by a powered lift mechanism mounted to said lift cart.

6. The device of claim 1, wherein said lift cart is configured to be moved about and fixed in place by a single caregiver.

7. The device of claim 1, wherein said lift cart includes a support base that is connected to a u-shaped frame and the legs of said u-shaped frame may be laterally extended.

8. The device of claim 1, wherein the recline position of said support surface is controlled by one of the following: a locking gas spring, an actuator, a hydraulic cylinder or a zero-gravity system.

9. A method for transferring a patient comprising the steps of:

(a) positioning a support surface beneath said patient by raising said support surface and laterally extending said support surface away from a lift cart while said support surface is securely cantilevered from said lift cart and said lift cart is temporarily fixed in place;

(b) laterally retracting said support surface towards said lift cart while said lift cart is temporarily fixed in place and said patient is supported by said support surface; and (c) transporting said patient on said support surface by moving said lift cart, wherein said support surface includes a seat frame with at least one female connection conduit, said lift cart includes at least one lift-fork, and said support surface may be securely cantilevered from said lift cart by inserting said at least one lift-fork into said at least one female connection conduit.

10. The method of claim 9, further comprising lowering said support surface in connection with positioning said support surface beneath said patient or after laterally retracting said support surface.

11. The method of claim 9, wherein said support surface and said patient may be in a fully reclined, semi-reclined or upright position during positioning or laterally retracting said support surface.

12. The method of claim 9, wherein said support surface includes a seat frame, back support, seat support, and leg support.

13. The method of claim 9, wherein said at least one female connection conduit extends laterally across the underside of said seat frame and said at least one lift-fork may be inserted into either a proximal or distal end of said at least one female connection conduit.

14. The method of claim 9, wherein said at least one lift-fork is mounted to a sliding sleeve that is raised and lowered by a powered lift mechanism mounted to said lift cart.

15. The method of claim 9, wherein said lift cart is configured to be moved about and fixed in place by a single caregiver.

16. The method of claim 9, wherein said lift cart includes a support base that is connected to a u-shaped frame and the legs of said u-shaped frame may be laterally extended.

17. The method of claim 9, wherein the recline position of said support surface is controlled by one of the following: a locking gas spring, an actuator, a hydraulic cylinder or a zero-gravity system.

18. A method for transferring a patient comprising the steps of:

(a) positioning a support surface beneath said patient, wherein said support surface includes at least one female connection conduit;

(b) temporarily positioning a lift cart in a fixed place near said support surface, wherein said lift cart includes at least one lift-fork;

(c) securely mounting said support surface to said at least one lift-fork by inserting said at least one lift-fork into an end of said at least one female connection conduit;

(d) laterally retracting said support surface towards said lift cart while said lift cart is temporarily fixed in place and said patient is supported by said support surface; and (e) moving said lift cart with said support surface cantilevered to said lift cart.

19. The method of claim 18, further comprising lowering said support surface in connection with positioning said support surface beneath said patient or after laterally retracting said support surface.

20. The method of claim 18, wherein said support surface and said patient are in a fully reclined, semi-reclined or upright position during positioning or laterally retracting said support surface.

21. The method of claim 18, wherein said support surface includes a seat frame, back support, seat support, and leg support.

22. The method of claim 18, wherein said at least one female connection conduit extends laterally across the underside of a seat frame of said support surface, includes at least two ends, and said at least one lift-fork may be inserted into either of said at least two ends of said at least one female connection conduit.

23. The method of claim 18, wherein said at least one lift-fork is mounted to a sliding sleeve that is raised and lowered by a powered lift mechanism mounted to said lift cart.

24. The method of claim 18, wherein said lift cart is configured to be moved about and fixed in place by a single caregiver.

25. The method of claim 18, wherein said lift cart includes a support base that is connected to a u-shaped frame and the legs of said u-shaped frame may be laterally extended.

26. The method of claim 18, wherein the recline position of said support surface is controlled by one of the following: a locking gas spring, an actuator, a hydraulic cylinder or a zero-gravity system.

27. The device of claim 1, wherein said at least one female connection conduit comprises a first female connection conduit attached at the front end of said seat frame and a second female connection conduit attached at the back end of said seat frame.

28. The method of claim 9, wherein said at least one female connection conduit comprises a first female connection conduit attached to the front end of said seat frame and a second female connection conduit attached to the back end of said seat frame.

29. The method of claim 18, wherein said at least one female connection conduit comprises a first female connection conduit attached to the underside of a front end of said support surface and a second female connection conduit attached to the underside of a back end of said support surface.

* * * * *